US007223222B2

(12) United States Patent
Anzini et al.

(10) Patent No.: US 7,223,222 B2
(45) Date of Patent: May 29, 2007

(54) SLIDER ZIPPER ASSEMBLY AND SHROUD WITH HIGH PRESSURE PASTEURIZATION PROTECTION SYSTEM

(75) Inventors: David J. Anzini, Farmington, NY (US); Steven Ausnit, New York, NY (US); Lars Wihlborg, Stratford, CT (US); Per Bentsen, Suffern, NY (US); Robert G. Kobetsky, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 24 days.

(21) Appl. No.: 11/173,581

(22) Filed: Jul. 1, 2005

(65) Prior Publication Data

US 2007/0004574 A1 Jan. 4, 2007

(51) Int. Cl.
*B31B 1/90* (2006.01)

(52) U.S. Cl. ..... 493/214; 493/212; 493/213; 493/927; 53/133.4; 53/139.2; 53/412

(58) Field of Classification Search ..... 493/212–214, 493/927; 53/133.4, 139.2, 412
See application file for complete search history.

(56) References Cited

U.S. PATENT DOCUMENTS

| | | | | |
|---|---|---|---|---|
| 5,283,932 | A * | 2/1994 | Richardson et al. | 24/400 |
| 2001/0001164 | A1* | 5/2001 | Van Erden | 24/381 |
| 2002/0015537 | A1* | 2/2002 | Strand et al. | 383/5 |
| 2005/0008267 | A1* | 1/2005 | Linton et al. | 383/61.2 |
| 2005/0069229 | A1* | 3/2005 | McCracken et al. | 383/61.2 |
| 2005/0157959 | A1* | 7/2005 | Johnson | 383/61.2 |
| 2006/0062495 | A1* | 3/2006 | Plourde et al. | 383/61.2 |
| 2006/0137147 | A1* | 6/2006 | Wihlborg | 24/415 |
| 2006/0228054 | A1* | 10/2006 | Anzini et al. | 383/61.2 |

* cited by examiner

*Primary Examiner*—Thanh Truong
(74) *Attorney, Agent, or Firm*—Day Pitney LLP

(57) ABSTRACT

The present disclosure relates to methods for forming reclosable bags with slider zippers which can be used in high pressure pasteurization. In particular, these methods form reclosable bags with a shroud formed over the slider zipper, with a patch or cap for protecting the slider during high pressure pasteurization. When the user tears the shroud from the bag, the patch or cap remains attached to the shroud but releases from the slider. An alternative embodiment forms an air pocket in the shroud to protect the slider.

7 Claims, 4 Drawing Sheets

SLIDER ZIPPER ASSEMBLY AND SHROUD WITH HIGH PRESSURE PASTEURIZATION PROTECTION SYSTEM

BACKGROUND OF THE INVENTION

1. Field of the Invention

The present invention pertains to a slider zipper assembly with a shroud that has high pressure pasteurization protection attached to the inside thereof. The present invention further pertains to a method for application of the zipper assembly to the film to form a reclosable package.

2. Description of the Prior Art

High pressure pasteurization (HPP) of food-containing packages is accomplished by placing the package in a chamber that is typically raised to 85,000 psi for a predetermined time period. Typical reclosable food packaging with "press to close" zippers will survive high pressure pasteurization. However, packages containing slider zipper assemblies have proven to be problematic. The zippers are typically enclosed in the packaging by the top portion of the packaging film, known as the shroud. During the high pressure pasteurization process, the extreme pressure pushes the shroud film onto the slider with such force as to punch holes in the film, rendering the package useless.

Commonly assigned U.S. patent application Ser. No. 11/020,607 entitled "Sleeve Cover for Slider", filed on Dec. 23, 2004, the contents of which are hereby incorporated by reference, discloses a semi-soft sleeve cover to shield the slider during high pressure pasteurization. Likewise, commonly assigned U.S. patent application Ser. No. 11/103,751 entitled "Reclosable Package with Slider Zipper Shielded for High Pressure Pasteurization", filed on Apr. 12, 2005, the contents of which are hereby incorporated by reference, discloses a shrouded reclosable bag wherein the slider shield is secured to the tear-away header so that the slider shield and the tear-away header are removed as a single piece. While these solutions are effective for their intended purpose, further improvements are desired with respect to the automated manufacture of these reclosable packages, particularly in combination with form fill and seal methods.

OBJECTS AND SUMMARY OF THE INVENTION

It is therefore an object of the present invention to provide a method and apparatus for producing a slider assembly that is suitable for use in a reclosable package that is processed with high pressure pasteurization.

It is therefore a further object of the present invention to improve the automation of the production of reclosable bags with slider zippers which are suitable for high pressure pasteurization.

It is therefore a still further object of the present invention to achieve the above objects in combination with a form fill and seal method and apparatus.

These and other objects are attained by providing a slider zipper assembly that contains a slider zipper profile, a slider clip, a film shroud formed over the zipper and a protective device inside the shroud for the purpose of protecting the slider clip during the high pressure pasteurization process. The protective device may include a molded or extruded soft cap over the slider, a semi-soft patch over the slider, a continuous film section containing a semi-soft layer, or a heavier gauge film strip over the slider with or without a sealed air pocket over the slider.

The slider zipper assembly is produced in a form ready for direct application to the film in a food packaging machine. The method of application includes the steps of feeding the slider zipper assembly from a continuous reel into the form fill seal machine along the with the package film. The slider zipper assembly is sealed to the film at the zipper flanges to form the top of the food package.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 2:
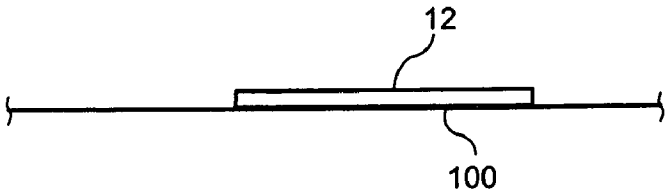
FIG. 2 is a cross-sectional view along plane 2—2 of FIG. 1.
Figure 1:
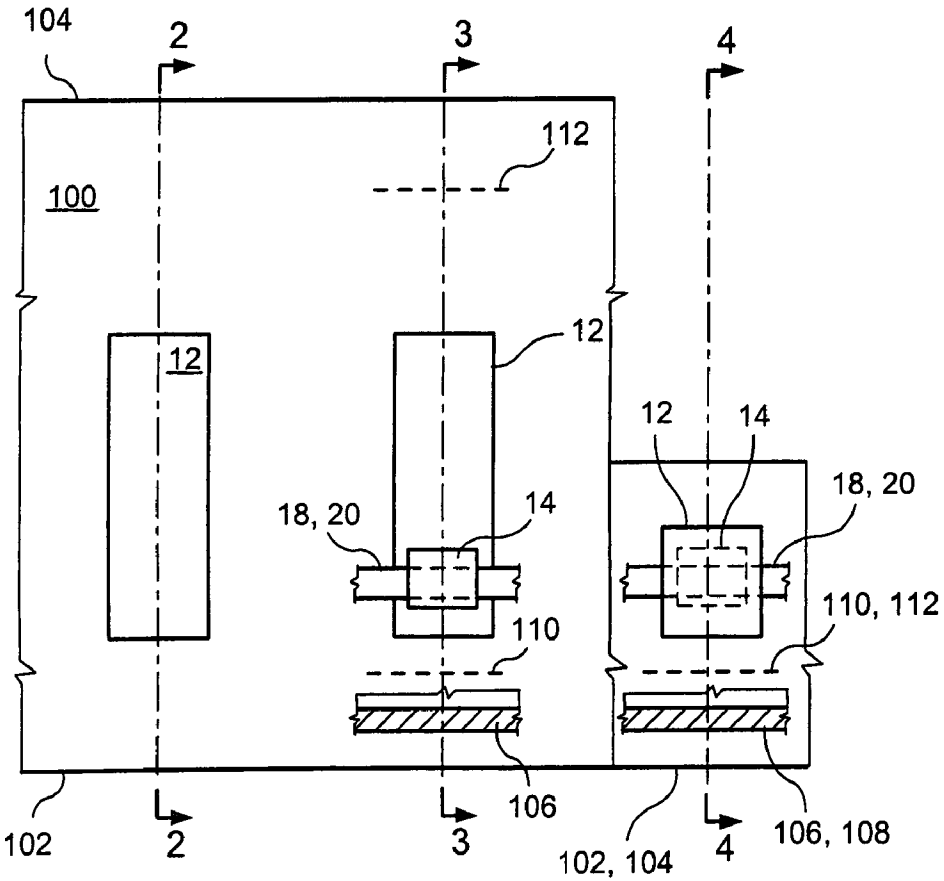
FIG. 1 is a top plan view of the film strip in the various stages of forming the first embodiment of the shrouded zipper assembly of the present invention.

Referring now to the drawings in detail wherein like numerals indicate like elements throughout the several views, one sees that FIG. 1 shows the film strip 100 in the various stages of forming the first embodiment of the shrouded zipper assembly 10 of the present invention. As shown near plane 2—2 of FIG. 1 and the cross-sectional view of FIG. 2, film strip 100, with first and second longitudinal edges 102, 104, is typically initially provided in a planar configuration. This configuration would be typical for the film strip 100 being provided from a roll as shown in FIG. 7, as will be discussed hereinafter. The slider shield 12 is placed on film strip 100 and secured thereto using a sufficiently strong adhesive, or tack seal, that slider shield 12 stays attached to film strip 100 during the removal of the resulting tear-away header, as described in U.S. patent application Ser. No. 11/103,751 entitled "Reclosable Package with Slider Zipper Shielded for High Pressure Pasteurization", filed on Apr. 12, 2005, the contents of which are hereby incorporated by reference. As described in this commonly owned application, slider shield 12 is made from material typically chosen from silicone, foamed polymeric materials, elastomeric sheet materials, tape, or polymer films with a thickness greater than that of the film forming the reclosable bag. Those skilled in the art will recognize a range of equivalents after study of the present disclosure.

Figure 3:
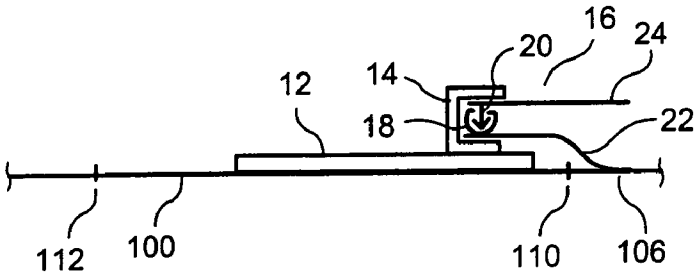
FIG. 3 is a cross-sectional view along plane 3—3 of FIG. 1.
Figure 4:
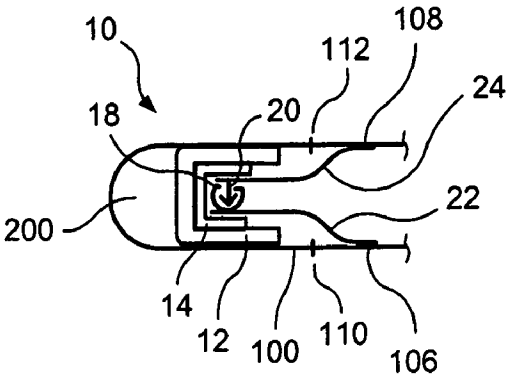
FIG. 4 is a cross-sectional view along plane 4—4 of FIG. 1.

Thereafter, as shown near plane 3—3 of FIG. 1 and the cross-sectional view of FIG. 3, slider 14 of zipper 16 is laid below (in the perspective and orientation shown in FIG. 1) the longitudinal mid-line of slider shield 12 and typically joined thereto by an adhesive which is relatively weak compared to the adhesive or tack seal holding the slider shield 12 to film strip 100 thereby allowing slider shield 12 to detach from slider 14 while remaining attached to the tear-away header formed from film strip 100. Zipper 16 includes first and second profiles 18, 20 with respective first and second flanges 22, 24. First flange 22 is sealed to film strip 100 along first seal line 106. Alternately, flanges 22, 24 can be sealed to film strip 100 as shown in FIG. 4, and strip 100 sealed to bag walls 150, 152, or both flanges 22, 24 and film strip 100 can be sealed at the same time to bag walls 150, 152. Tear lines 110, 112 are also provided as previously indicated. Additionally, first line of weakness 110 is formed in film strip 100 between slider shield 12 and first seal line 106. Likewise, second line of weakness 112 is formed in film strip 100 between slider shield 12 and where second seal line 108 (described hereinafter) is formed.

Thereafter, as shown near plane 4—4 of FIG. 1 and the cross-sectional view of FIG. 4, film strip 100 is thereafter folded around a longitudinal mid-point thereof and first and second longitudinal edges 102, 104 are brought together so that slider shield 12 is brought around slider 14 and secured thereto by a relatively weak adhesive. Second flange 24 is sealed to film strip 100 inwardly adjacent from second longitudinal edge 104 along second seal line 108. FIG. 4 is shown with a variation including a loop 200 in film strip 100 formed above slider 14.

Figure 5:
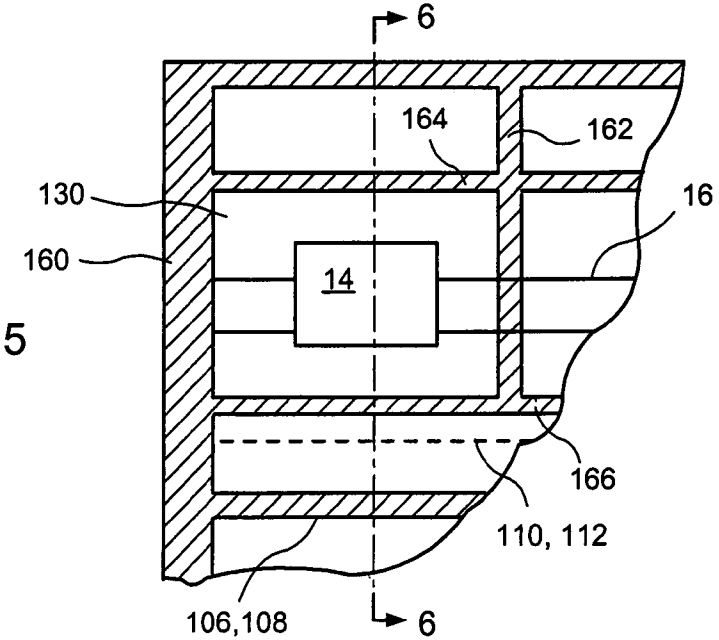
FIG. 5 is a plan view of a second embodiment of the shrouded zipper assembly of the present invention wherein an air pocket is formed to provide further shielding of the slider.
Figure 6B:
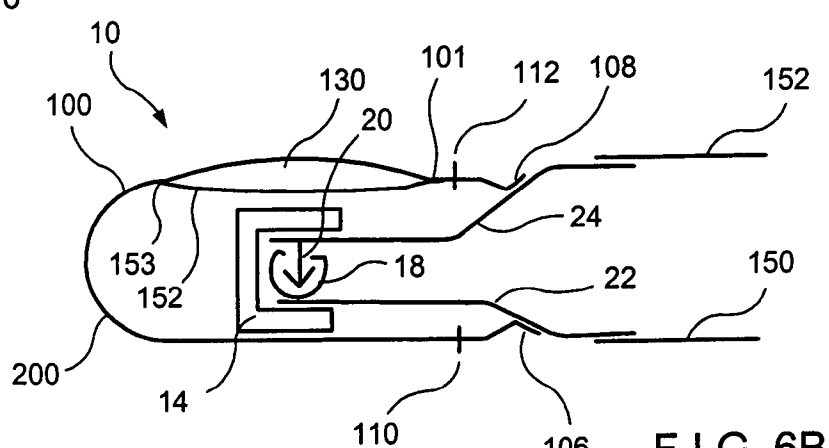
FIG. 6B is an alternative cross-sectional view along plane 6—6 of FIG. 5.
Figure 6A:
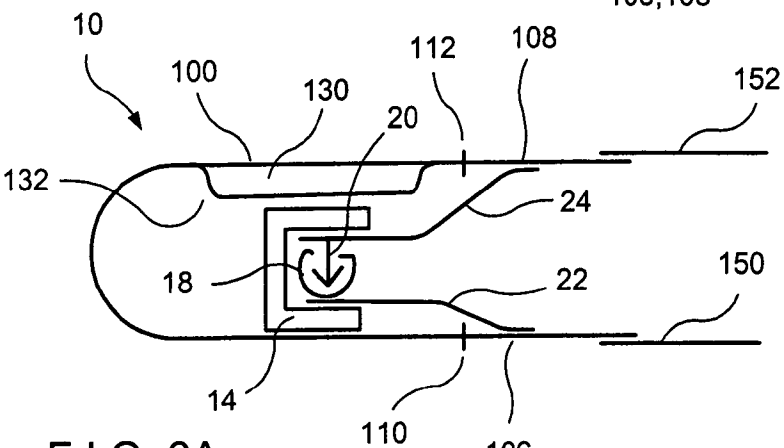
FIG. 6A is a cross-sectional view along plane 6—6 of FIG. 5.

A further embodiment is shown in FIGS. 5, 6A and 6B wherein an air pocket 130 is formed in lieu of a slider shield 12. Air pocket 130 is formed by a strip 132 sealed to the interior of the shroud formed by film strip 100 as shown in FIG. 6A. Lower and upper bag walls 150, 152 are sealed to and extend from first and second flanges 22, 24. Alternatively, as shown in FIG. 6B, upper bag wall 152 can extend past second flange 24 whereby upper bag wall 152 forms the interior wall of air pocket 130 while film strip 100 forms the exterior wall of air pocket 130. In other words, edge 153 of upper bag wall 152 is sealed to film strip 100 and edge 101 of film strip 100 is sealed to upper bag wall 152.

As shown in FIG. 5, air pocket 130 is bounded by end seal 160, cross seal 162 and longitudinal seals 164, 166.

Figures 7A, 7B:
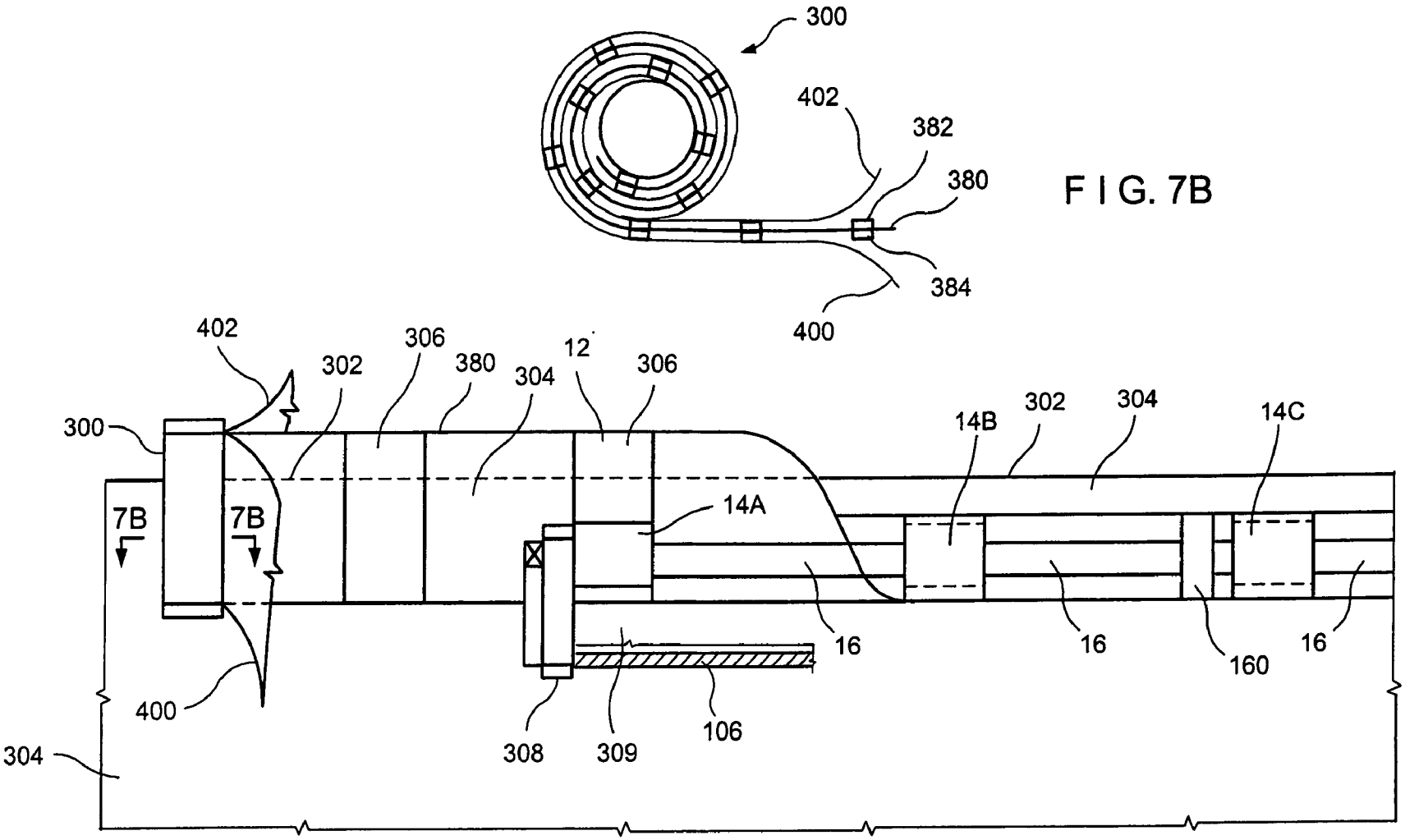
FIG. 7A is a plan view of the manufacturing process, in further detail of the shrouded zipper of the present invention.
FIG. 7B is a cross-sectional view along plane 7B—7B of FIG. 7A.
Figure 9:
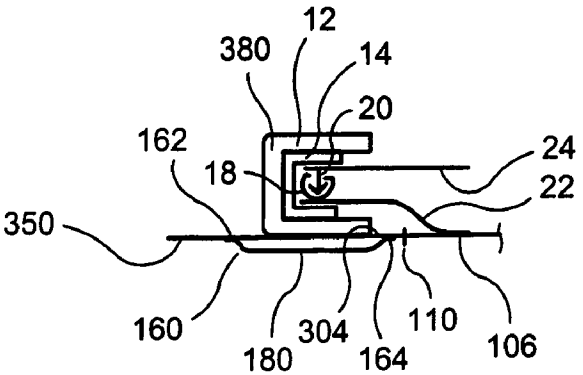
FIG. 9 is a cross-sectional view along plane 9—9 of FIG. 8, prior to application of the second sheet of film.
Figure 11:
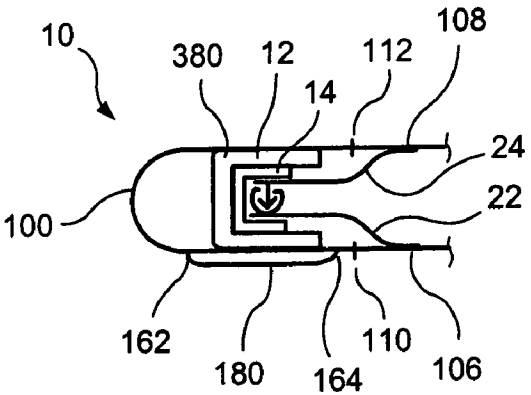
FIG. 11 is a cross-sectional view showing a further alternative embodiment to FIG. 10.
Figure 8:
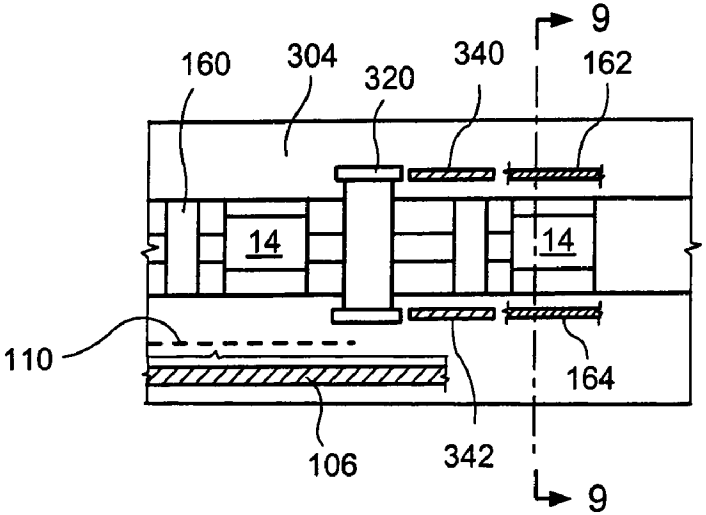
FIG. 8 is a plan view of the embodiment of FIG. 7A, illustrating subsequent steps.
Figure 10:
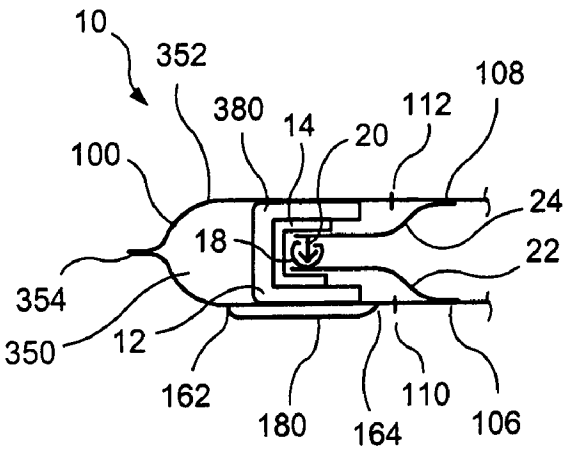
FIG. 10 is a cross-sectional view similar to that along plane 9—9 of FIG. 8, after the application of the second sheet of film.

A further process is shown in detail in FIGS. 7A and 8. A continuous roll of semi-soft or similar material 380 (such as slider shield 12 is made from) is supplied from roll 300, wherein material 380 extends over and above the edge 302 of film 304, which forms one bag wall of the reclosable bag to which one side of material 380 is applied. As shown in FIG. 7B, material 380 is indexed with patches 306 of relatively strong adhesive 382 on one side (the sides that are applied to the bag walls) and relatively weak adhesive 384 on the other side (the sides that are applied to and over the slider 14). Non-stick layers of film 400, 402 are applied on both sides of material 380 to prevent the adhesive patches 306 (comprising strong and weak adhesive 382, 384) from sticking to the material 380, with non-stick layers of film 400, 402 being peeled off as material 380 is unwound. The adhesive patches 306 are indexed, depending on the size of the bag to which they are to be applied, to the position that slider 14 will have when the zipper 16 is attached to the bag walls. Zipper 16 with mounted sliders $\mathbf{14}_A$, $\mathbf{14}_B$, $\mathbf{14}_C$ is attached to bag wall 304 at location 309 so that the sliders 14 are, as indicated, indexed to the adhesive patches 306. Lower flange 22 (see FIG. 9) of zipper 16 is sealed to film 304 at seal 106. Material 380 is then folded over sliders $\mathbf{14}_A$, $\mathbf{14}_B$, $\mathbf{14}_C$ and pressed onto the sliders. The sliders $\mathbf{14}_A$, $\mathbf{14}_B$, $\mathbf{14}_C$ are now attached to continuous folded material 380 by the indexed adhesive patches with weak adhesive 384, while strong adhesive patches 382 attach material 380 to bag wall 304. Thereafter, cut-outs 160 are punched out through the folded soft material 380 and the lower bag film 304 at the locations of future cross seals, because material 380 would otherwise impede satisfactory cross seals. To cover punched out cut-outs in bag wall 304, film strip 180 is introduced from roll 320 from below bag wall 304 and continuously sealed by seal bars 340 and 342 to bag wall 304 at seals 162, 164. Perforations or tear line 110 can be formed in bag wall 304 at this time or earlier in the process. Bag wall 352, which can be from a separate film, is applied over the zipper 16, and sealed to bag wall 304 at seal 354. Alternately, bag wall 304 can be folded over the zipper to form bag wall 352. Simultaneously, bag wall 352, with preformed perforation or tear line 112, is pressed onto the strong adhesive patches 382 on the outside of material 380 (see FIG. 10). Alternately, the same process can be used to attach material 380 to a separate strip, which is then attached to the film(s), forming the bag walls as shown in FIG. 11.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method of manufacturing at least a portion of a reclosable bag, including the steps of:

providing a film sheet;

attaching a patch or cap to said film sheet;

providing a zipper comprising a first interlocking profile including a first flange, a second interlocking profile including a second flange, and a slider;

attaching a first side of said slider to said patch or cap;

sealing said first flange to said film sheet along a first seal line;

folding said film sheet over said slider;

attaching a second side of said slider to said patch or cap; and sealing said second flange to said film sheet along a second seal line;

wherein said first and second sides of said slider are attached to said patch or cap by adhesive or tack sealing.

2. The method of claim 1 further including the step of providing a first line of weakness in said film sheet between said first seal line and said slider.

3. The method of claim 2 further including the step of providing a second line of weakness in said film sheet between said second seal line and said slider.

4. The method of claim 3 wherein steps of attaching said first and second sides of said slider to said patch or cap results in an attachment which is weaker than achieved by said step of attaching said patch or cap to said film sheet, whereby said patch or cap remains attached to a portion of said film sheet when said portion of said film sheet is torn away along said first and second lines of weakness.

5. The method of claim 1 wherein said step of attaching said patch or cap to said film sheet is performed by tack sealing.

6. The method of claim 1 wherein said step of attaching said patch or cap to said film sheet is performed by adhesive.

7. The method of claim 1 further including the step of treating the reclosable bag with high pressure pasteurization.

* * * * *